US005114049A

United States Patent [19]

Knickerbocker

[11] Patent Number: 5,114,049

[45] Date of Patent: May 19, 1992

[54] CHILD-RESISTANT TRIGGER SPRAYER

[75] Inventor: Michael G. Knickerbocker, Upland, Calif.

[73] Assignee: Calmar Inc., City of Industry, Calif.

[21] Appl. No.: 606,455

[22] Filed: Oct. 31, 1990

[51] Int. Cl.[5] ..... B67B 5/00

[52] U.S. Cl. ..... 222/153; 222/384

[58] Field of Search ..... 222/153, 402.11, 385, 222/384, 402

[56] References Cited

U.S. PATENT DOCUMENTS

| | | | |
|---|---|---|---|
| 3,828,982 | 8/1974 | Steigerwald | 222/402.11 X |
| 3,940,023 | 2/1976 | Umstead | 222/402.11 X |
| 4,805,812 | 2/1989 | Brody | 222/402.11 |
| 4,880,143 | 11/1989 | Murray et al. | 222/402.11 X |
| 4,946,074 | 8/1990 | Grogan | 222/153 |
| 4,982,900 | 1/1991 | Blake | 222/402 X |

*Primary Examiner*—Kevin P. Shaver
*Assistant Examiner*—Gregory L. Huson
*Attorney, Agent, or Firm*—Watson, Cole, Grindle & Watson

[57] ABSTRACT

A child-resistant trigger operated pump dispenser has a latch pivotally mounted on the trigger for preventing trigger actuation. The latch has an arm projecting forwardly of the trigger to facilitate pivotal movement of the latch against the bias of the spring for unlocking the trigger to permit pumping. The latch is automatically returned to its locking position at the end of each pumping operation.

12 Claims, 2 Drawing Sheets

CHILD-RESISTANT TRIGGER SPRAYER

BACKGROUND OF THE INVENTION

This invention relates generally to a manually operable pump dispenser of the trigger actuated type, and more particularly to such a dispenser as having means pivotally mounted on the trigger actuator for disenabling trigger actuation to thereby render the dispenser child-resistant.

Manually actuated pump dispensers are rendered child-resistant by the provision of some type of locking means which prevents pumping operation. For especially poisonous products such as insecticides, the dispenser is rendered child-proof by the provision of some type of lock requiring the operator to perform at least one operation in addition to that normally required for pump actuation for trigger actuated dispensers. Various types of trigger immobilizers have been devised for preventing trigger actuation requiring performance of some type of trigger unlocking operation prior to pumping.

The need arises for an improvement on existing child-proof trigger actuated dispensers given the limitations of the existing art, as well as their relative complexity, economy consideration and difficulty to mass produce.

SUMMARY OF THE INVENTION

It is therefore an object of the present invention to provide a child-resistant trigger actuated dispenser in which the trigger is locked against actuation by a simple latch device which renders its easy to operate by an adult but difficult for the child, yet it is highly economical and easy to mass produce.

According to the invention, the latch device is pivotally mounted on the trigger lever, the latch having a nose-piece in abutting engagement with some confronting portion of the pump body for preventing trigger actuation. The latch is maintained in this locked position by the provision of a pair of spaced support walls on the lever. The latch has a forwardly extending arm or projection capable of being pulled downwardly or pushed upwardly, or both, by the operator, against the bias of a spring, for unlocking the trigger just prior to pulling back on the trigger in a normal operation.

The spring may be in the form of a spring tab integral with the latch and located beneath the nosepiece to facilitate pivotal movement of the latch as the arm is pushed upwardly by an upward force applied by the hand used in squeezing the trigger. Otherwise, the spring tab may be integral with the latch and located beneath the latch arm, in which case the latch is pivoted as the arm is pulled downwardly by the finger of the operator used in squeezing the trigger. Still further, the spring tab may be integral with the trigger lever, and another spring tab integral with the latch located beneath the nose piece, so that the latch may be pivoted in both directions as the latch arm is moved either upwardly or downwardly. Spring bias of the tabs functions to automatically return the latch to its locked position upon release of the latch arm.

Other objects, advantages and novel features of the invention will become more apparent from the following detailed description of the invention when taken in conjunction with the accompanying drawings.

DETAILED DESCRIPTION OF THE INVENTION

Figure 1:
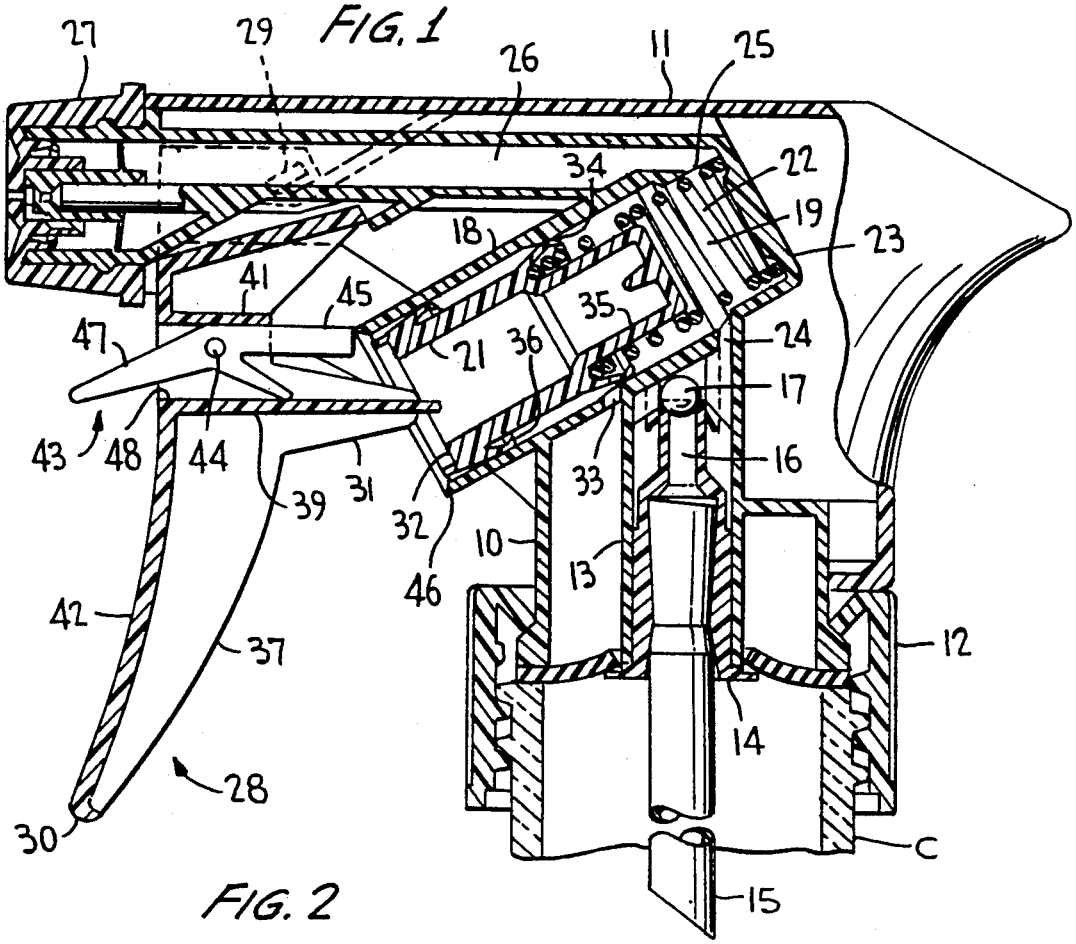
FIG. 1 is a side elevational view of a manually actuated dispensing pump incorporating the child resistant feature of the invention, partly broken away and sectioned, the trigger actuator being shown in its locked position.

Turning now to the drawings wherein like reference characters refer to like and corresponding parts throughout the several views, the pump structure illustrated in the drawings is of the general type disclosed in U.S. Pat. No. 4,747,523, commonly owned herewith. The child-resistant feature of the invention is disclosed for use with this prior patented pump, although the invention is likewise adaptable for use with any trigger actuated pump structure.

The pump represented in the drawings comprises a pump housing or body 10 which may have an outer shroud cover 11, the body being adapted for mounting with a closure cap 12 at the neck of a container C not otherwise shown. An inner cylinder 13 of the pump body supports a tube retainer 14 which suspends a conventional dip tube 15 extending into the interior of the container. The dip tube and upper end of the tube retainer define and inlet passage 16 which is valve controlled by a conventional ball check valve 17 supported on a valve seat at the upper end of the tube retainer.

A pump cylinder 18 located above the closure cap opens at its outer end to the atmosphere and has at its inner end region a pump chamber 19 for a manually reciprocable pump piston 21. A coil return spring 22 extends between a wall 23 of the pump chamber and some suitable portion of the piston for extending the piston outwardly of the cylinder to its inoperative position of FIG. 1.

The inlet passage terminates in an inlet port 24 which opens into the pump chamber. A discharge port 25 opening from the pump chamber communicates with discharge passage 26 which is valve controlled by suitable valving located within a rotable nozzle cap 27.

A trigger lever actuator 28 is hinged at its upper end 29 to the pump body, the trigger having a rearwardly extending tup 31 intermediate its upper end 29 and its opposing free end 32, the tup bearing against an outer circular rim 33 of the piston.

Pump cylinder also has a sump/vent port 33.

The pump piston has an inboard annular piston seal 34 in sealing engagement with the wall of the pump chamber. This piston seal extends in a direction toward the pump chamber and is spaced from cylindrical wall 35 of the nose of the piston to form a convenient shoulder for the reception of return spring 22. And, the piston has an outboard annular piston seal 36 which sealingly engages the wall of cylinder 18 in the inoperative position shown in FIG. 1.

Figure 2:
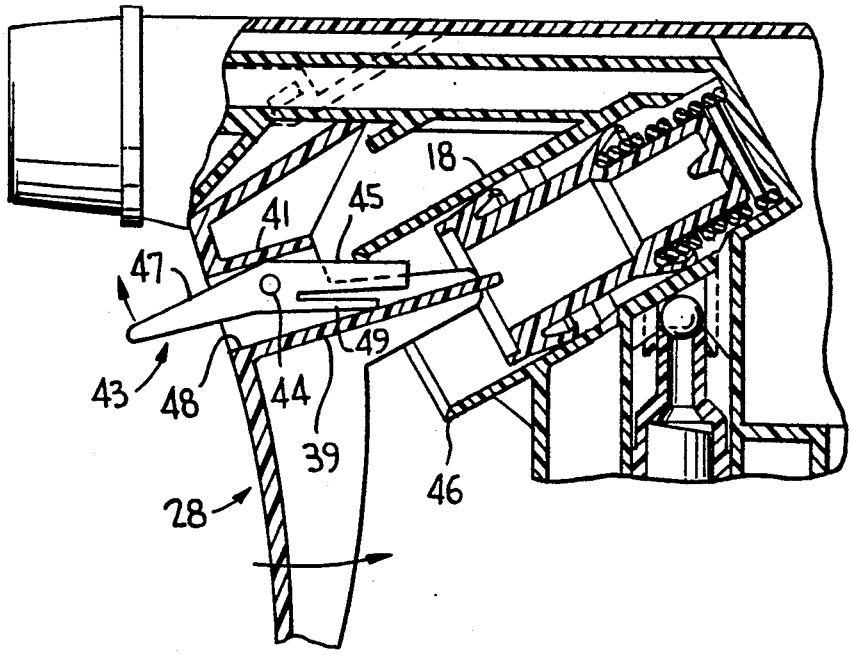
FIG. 2 is a view similar FIG. 1 with the trigger lever shown in its unlocked position.

To operate the pump, the trigger is simply pulled back using 2 or 3 finger of the operator's hand for shifting the piston inwardly, as shown in FIG. 2, against the force of the return spring, and releasing the trigger to return to its FIG. 1 position.

The trigger lever comprises a pair of spaced sidewalls 37, 38 (FIG. 4), with tup 31 extending from each sidewall so at to bear against piston rim 32. A transverse wall 39 spans side walls 37, 38 and partially extends into the hollow end of the piston 32 to avoid any slippage or disengagement of the tup from the piston rim.

The trigger lever has another transverse wall 41 which spans sidewalls 37, 38, is spaced from and lies parallel to wall 39. And, the trigger has a slightly curved front wall 42 presenting a forward finger engaging surface of the trigger.

Figure 3:
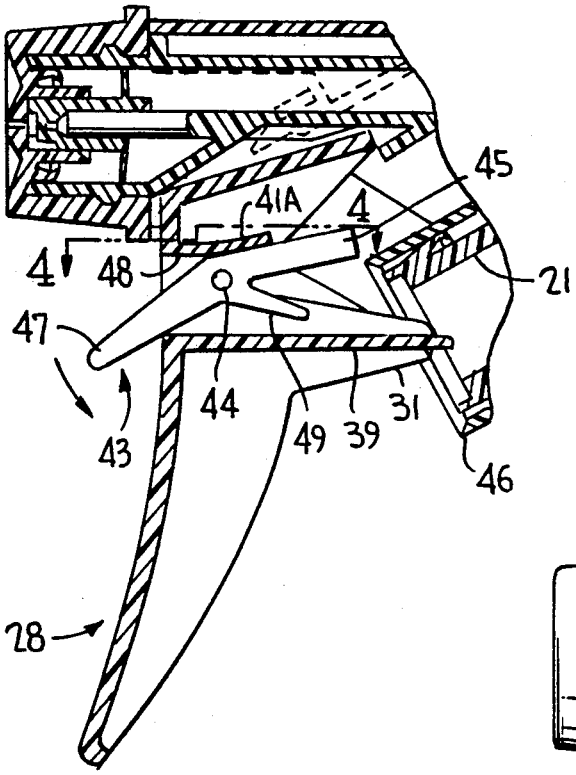
FIG. 3 is a view similar FIG. 1 showing a reduced portion of the dispenser incorporating a latch according to another embodiment of the invention.

In accordance with the invention, latch means, generally designated 43 in FIGS. 1–3, is provided for locking trigger lever 28 in the inoperative position of the pump piston, shown in FIG. 1. The latch means comprises a latch pivotally mounted on the trigger lever between opposing side walls 37, 38 thereof as by means of a pivot pin 44 (FIG. 4) spanning the sidewalls. The latch is supported in a first position between transverse walls 39 and 41 of the trigger lever for preventing actuation, as shown. The latch has a rearwardly extending nosepiece or extension 45 which may have a blunt end, and of a predetermined length as to a butt against a confronting portion of the pump body, such as free end 46 of pump cylinder 18.

And, the latch has a forwardly extending arm or projection 47 extending outwardly beyond the front wall 42 of the trigger lever through a suitable slot 48 formed therein. Arm 47 has a predetermined length as to lifed by, for example, the upward surface of the operator's forefinger at the time the trigger lever is actuated, as will be described more fully hereinafter.

The latch further includes an integral spring tab 49 which bears against transverse wall 39 as shown, while the upper flat surface of extension 45 bears against transverse wall 41 in the FIG. 1 position. Spring tab 49, or some other equivalent resilient means such as a coil spring, a leaf spring, a resilient pad, or the like, is located beneath extension 45.

In operation, the operator simply grasps trigger lever 28, usually with the forefinger and middle finger of one hand, while the trigger lever is in its forwardly extended position of FIG. 1 with extension 45 in abutting engagement with free end 46 of the pump cylinder which locks the trigger lever against trigger actuation. While the trigger lever is grasped in this condition, application of a slight upward force against projection 47, by simply shifting the forefinger of the operator in the direction of the arrow of FIG. 2, pivots the latch at its pivot pin in a clockwise direction viewed in FIG. 2, thereby causing extension 45 to pivot downwardly and out of engagement with free end 46 against the bias of spring tab 49, instantaneously prior to pulling back on the trigger lever which thereby permits the lever to be actuated for pumping. As shown in FIG. 2, extension 45 simply moves slightly into the hollow open end of pump cylinder 18, without interfering with either the pump cylinder or the pump piston.

Upon release of the trigger lever, the pump piston reciprocates outwardly in its pump cylinder under the action of the return spring 22, for suctioning product from the container into the pump chamber as in the normal pumping operation. Continued pumping and suction strokes are faciliated upon repeated pulls of the trigger lever while the operator maintains the pivoted attitude of the latch as shown in FIG. 2. At the end of a given pumping operation, the operator simply relaxes his grip on the trigger lever and releases projection 47 at which time spring tab 49 automatically pivots the latch back to its FIG. 1 position at which extension 45 again butts against free end 46.

Figure 4:
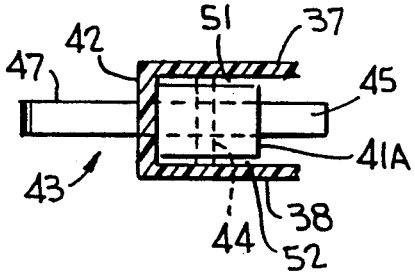
FIG. 4 is a sectional view taken substantially along the line 4—4 of FIG. 3.

Since upper transverse wall 41 fully spans side walls 37, 38 of the trigger lever in the FIGS. 1 and 2 embodiment, the latch is arranged to pivot only in the clockwise direction shown, i.e., as projection 47 is shifted in the direction toward upper end 29 of the trigger. However, by providing longitudinal slits 51, 52 between wall 41 and side walls 37 and 38 as shown in FIG. 4, the transverse wall may be converted into a spring tab 41A. Thus, the latch may now be shifted in a counter-clockwise direction, when viewed in FIG. 3, as the operator depressed projection 47 with his forefinger as he grasps the trigger lever to thereby release extension 45 from its engagement with free end 46, as shown in FIG. 3. The trigger may then be pulled for pumping as aforedescribed without interference by extension 45 with either the pump cylinder or the pump piston. Depression of projection 47 in the direction of the arrow of FIG. 3, pivots the latch against the bias of spring tab 41A, so that upon release of the latch by the operator, the spring tab automatically returns the latch back to its locked position of FIG. 1. Of course, the latch in the FIG. 3 embodiment may likewise be pivoted in a clockwise direction by shifting projection 47 upwardly in the direction of the arrow FIG. 2, as described with reference to FIGS. 1 and 2. The FIG. 3 embodiment therefore permits projection 47 to be either pushed upwardly or pulled downwardly by the operator for unlocking the trigger lever.

Figure 5:
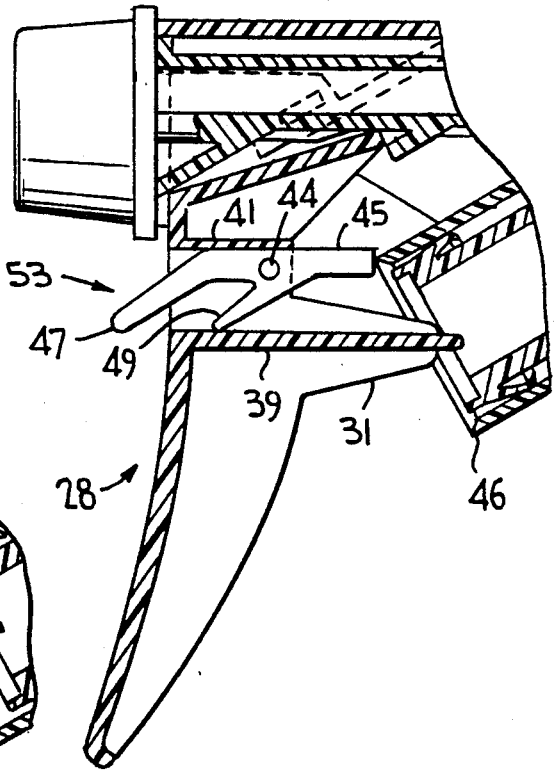
FIG. 5 is a view similar to FIG. 1 showing a reduced section of the dispenser incorporating a latch according to another embodiment of the invention.
Figure 6:
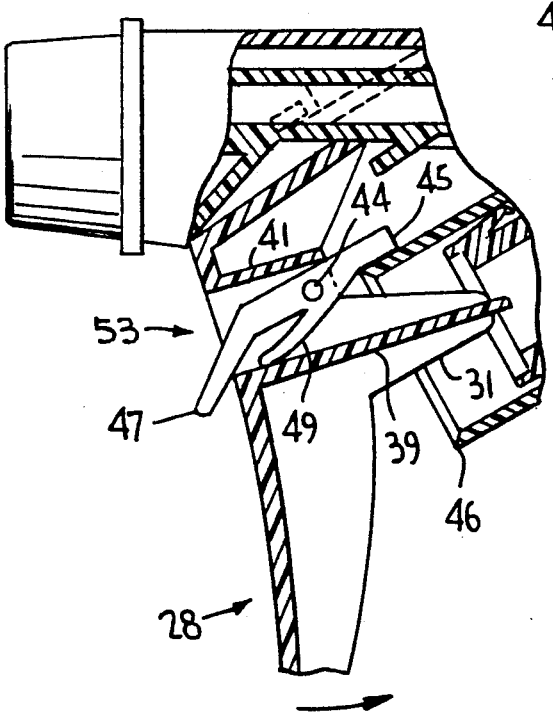
FIG. 6 is a view similar to FIG. 5 showing the trigger lever in its unlocked position.

In another embodiment shown in FIGS. 5 and 6, latch means, generally designated 53, is pivotally mounted on the trigger lever, similarly as described with reference to FIG. 1, and is positioned between transverse walls 39 and 41. Extension 45 of the latch, in the FIG. 5 position, butts against free end 46 for disenabling or locking the trigger against actuation. In this version, spring tab 49 underlies projection 47 of the latch thereby permitting the latch to be pivoted counterclockwise when viewed in FIGS. 5 and 6, as projection 47 is pulled downwardly by the operator in the direction of the arrow shown for unlocking the trigger just prior to trigger actuation. As shown in FIG. 6, extension 45 is shifted out of engagement with free end 46 of the pump cylinder thereby facilitating trigger actuation during pumping without interference with the pump cylinder or with the pump piston. Again, at the end of a given pumping operation, the operator simply releases projection 47 where upon spring tab 49 automatically returns the latch to its locked position of FIg. 5.

From the foregoing, it can be seen that a simple and economical yet highly effective manually actuated latch is provided for locking the trigger lever against actuation to thereby render the pump dispenser fully child-resistant. Projection 47 of the latch is either pushed upwardly, or downwardly, or both, depending on the arrangement described, by the same hand of the operator used in grasping the trigger lever such that little effort is required by the adult operator in maintaining the latch in its unlocked position during use, while at the same time providing for a similar operation incapable of being carried out by the child. And, each time projection 47 of the latch is released, at the end of each pumping operation, the spring tab, or other resilient means employed, automatically returns the latch to its locked position.

Obviously, many other modifications and variations of the present invention are made possible in the light of the teachings. It is therefore to be understood that within the scope of the appended claims the invention may be practiced otherwise than as specifically described.

What is claimed is:

1. A child-resistant trigger operated pump dispenser comprising, a pump body for mounting with a closure cap at the upper end of a container for fluent product, a trigger lever actuator pivotally mounted at an upper end thereof to said body, said actuator having an opposing free end and rearwardly extending means intermediate said ends for actuating said pump dispenser upon manual operation of said lever, said actuator having a forward finger engaging surface extending between said ends, the improvement wherein latch means is supported on said lever for preventing trigger actuation in a first position of said latch means, said latch means having an extension in abutting engagement with a confronting portion of said pump body in said first position and being pivotally mounted on said lever, biasing means acting on said latch means, said latch means having a projection extending forwardly beyond said finger engaging surface for manually pivoting said latch means against the bias of said biasing means from said first position to a second position in which said extension is out of engagement with said pump body to permit trigger actuation, said biasing means automatically returning said latch means to said first position.

2. The dispenser according to claim 1, wherein said biasing means comprises a spring tab.

3. The dispenser according to claim 2, wherein said spring tab is integral with said latch means.

4. The dispenser according to claim 1, wherein said biasing means is integral with said lever.

5. The dispenser according to claim 1, wherein said biasing means is located beneath said extension permitting pivotal movement of said latch means as said projection is moved toward said upper end.

6. The dispenser according to 1, wherein said biasing means is located beneath said projection permitting pivotal movement of said latch means as said projection is moved toward said free end.

7. The dispenser according to 5, wherein said biasing means comprises a spring tab integral with said latch means.

8. The dispenser according to 2, wherein said spring tab is integral with said lever.

9. The dispenser according to 6, wherein said biasing means comprises a spring tab integral with said latch means.

10. The dispenser according to 1, wherein said biasing means is located above said extension permitting pivotal movement of said latch means as said projection is moved toward said free end.

11. The dispenser according to 10, wherein said biasing means located above said latch means is and comprises a spring tab integral with said lever.

12. The dispenser according to 1, wherein said pump body includes a pump cylinder and a reciprocable piston operable within said cylinder for defining together therewith a variable volume pump chamber, said latch means extension abutting an edge of said cylinder in said first position.

* * * * *